US006576599B1

(12) United States Patent
Stone

(10) Patent No.: US 6,576,599 B1
(45) Date of Patent: Jun. 10, 2003

(54) COATED LAUNDRY AND/OR AUTOMATIC DISHWASHING TABLETS HAVING A CHAMFERED EDGE FOR IMPROVED STRUCTURAL INTEGRITY

(75) Inventor: Thomas Edward Stone, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/674,048

(22) PCT Filed: Apr. 21, 1999

(86) PCT No.: PCT/IB99/00711

§ 371 (c)(1),
(2), (4) Date: Oct. 25, 2000

(87) PCT Pub. No.: WO99/55823

PCT Pub. Date: Nov. 4, 1999

Related U.S. Application Data

(60) Provisional application No. 60/083,257, filed on Apr. 27, 1998.

(51) Int. Cl.[7] ..... C11D 17/00; B08B 9/20; D06L 1/00

(52) U.S. Cl. ..... 510/224; 510/228; 510/392; 510/446; 510/497; 134/25.2

(58) Field of Search ..... 510/446, 447, 510/477, 441, 224, 294, 298, 392; 134/25.2

(56) References Cited

U.S. PATENT DOCUMENTS

| | | | | | |
|---|---|---|---|---|---|
| 4,460,490 | A | * | 7/1984 | Barford et al. | 252/92 |
| 5,391,378 | A | * | 2/1995 | Sanderson | 424/464 |
| 5,759,974 | A | * | 6/1998 | Menke et al. | 510/191 |
| 6,340,664 | B1 | * | 1/2002 | Gassenmeier et al. | 510/441 |
| 6,462,007 | B1 | * | 10/2002 | Pieroni et al. | 510/224 |
| 6,486,117 | B1 | * | 11/2002 | Painter et al. | 510/446 |

FOREIGN PATENT DOCUMENTS

| | | | |
|---|---|---|---|
| EP | 0070720 | * | 1/1983 |
| EP | 0711827 | * | 5/1996 |
| WO | 99/27063 | * | 6/1999 |

* cited by examiner

*Primary Examiner*—Necholus Ogden
(74) *Attorney, Agent, or Firm*—Armina E. Matthews; Jason J. Camp; Kim W. Zerby

(57) ABSTRACT

A laundry and/or automatic dishwashing tablet including a core (10) formed by compressing a particulate material, wherein the particulate material includes a detersive surfactant and a builder. The core (10) is compressed into a tubular configuration having a polygonal cross section and a plurality of surfaces meeting to form a plurality of edges, thereby forming a contoured core (10), wherein at least one of the plurality of edges is chamfered (20). The non-particulate detergent product further includes a coating (12) which substantially covers the contoured core (10).

16 Claims, 1 Drawing Sheet

COATED LAUNDRY AND/OR AUTOMATIC DISHWASHING TABLETS HAVING A CHAMFERED EDGE FOR IMPROVED STRUCTURAL INTEGRITY

This application claims the benefit of provisional application 60/083,257 filed Apr. 27, 1998.

TECHNICAL FIELD

The present invention relates to detergent compositions in non-particulate form that have a protective coating. More particularly, the invention relates to coated non-particulate detergent products e.g., tablet, block or bar, having a specially contoured surface which reduces the coating's susceptibility to being chipped or broken away during manufacture, storage and handling.

BACKGROUND OF THE INVENTION

Non-particulate detergents are an attractive alternative to granular or particulate forms of detergents from the standpoint of simplifying the dosing of such detergents for automatic laundry or dishwashing machines. Non-particulate detergents are usually supplied in the form of bars, tablets or briquettes and they not only prevent spillage of the detergent composition but also eliminate the need for the consumer to estimate the correct dosage of the detergent composition per wash. Non-particulate detergents minimize the contact by the consumer with the detergent.

In order to improve the hardness of a non-particulate detergent, such as a tablet, the tablets are occasionally encapsulated by a protective coating, which is broken when the tablet is immersed in water in the washing machine, thereby exposing the soft core which breaks up easily and rapidly, releasing the active ingredients into the wash solution. However, one problem frequently encountered with coated detergent tablets is that during manufacture, transportation, storage and handling, the coating can get chipped or broken away, especially around sharp edges or corners, by either rubbing against each other or against another surface. This not only reduces the structural integrity of the detergent tablet but also takes away from its appearance and aesthetics. Most consumers do not like to purchase a detergent tablet product which is chipped or has broken edges.

It is thus highly desirable to have a coated detergent tablet product having a surface configuration which reduce the coating's susceptibility to chipping and fracture so that the coating remains adhered to the tablet during packaging, transport, storage and handling prior to eventual use.

BACKGROUND ART

The prior art is replete with methods of forming and coating tablets.

GB-A-0 989 683, published on Apr. 22, 1965, discloses a process for preparing a particulate detergent from surfactants and inorganic salts; spraying on water-soluble silicate; and pressing the detergent particles into a solid form-retaining tablet. Finally a readily water-soluble organic film-forming polymer (for example, polyvinyl alcohol) provides a coating to make the detergent tablet resistant to abrasion and accidental breakage.

EP-A-0 002 293, published on Jun. 13, 1979, discloses a tablet coating comprising hydrated salt such as acetate, metaborate, orthophosphate, tartrate, and sulphate.

EP-A-0 716 144, published on Jun. 12, 1996, also discloses laundry detergent tablets with water-soluble coatings which may be organic polymers including acrylic/maleic co-polymer, polyethylene glycol, PVPVA, and sugar.

SUMMARY OF THE INVENTION

The invention meets the needs above by providing a non-particulate detergent product including, a core formed by compressing a particulate material comprising a detersive surfactant and a builder. The core is compressed into a tubular configuration having a polygonal cross-section and a plurality of surfaces meeting to form a plurality of edges, thereby forming a contoured core, wherein at least one of the plurality of edges is chamfered. The non-particulate detergent product further includes a coating which substantially covers the contoured core.

DETAILED DESCRIPTION OF THE INVENTION

Figure 1:
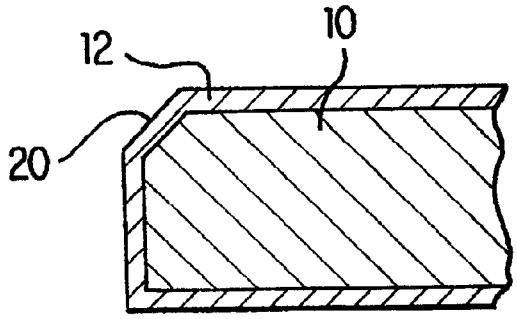
FIG. 1 shows a cross-sectional view of a portion of the detergent core, showing the details of a chamfer according to one embodiment of the present invention.

In the preferred embodiment of the present invention, a core is formed by compressing a particulate material comprising a detersive surfactant and a builder.

The Particulate Detergent Composition

The term "particulate" as used herein means forms such as powders, granules, particles, flakes and other similar particulate forms that are capable of being compacted into a more dense non-particulate form.

In particular for laundry tablets, detergent particles having ingredients such as builder and surfactant can be spray-dried in a conventional manner and then compacted at a suitable pressure. The surfactants and builders normally provide a substantial part of the cleaning power of the tablet. The term "builder" is intended to mean all materials which tend to remove calcium ion from solution, either by ion exchange, complexation, sequestration or precipitation.

The particulate material used for making the detergent tablet provided in this invention can be made by any particulation or granulation process. An example of such a process is spray drying (in a co-current or counter current spray drying tower) which typically gives "spray-dried" detergent granules having low bulk densities of 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallization sentering, etc. The individual particles can also be in any other form, such as for example, particle, granule, sphere or grain.

The particulate materials may be mixed together by any conventional means, for example, a concrete mixer, Nauta mixer, ribbon mixer or any other. Alternatively the mixing process may be carried out continuously by metering each component by weight on to a moving belt, and blending them in one or more drum(s) or mixer(s). A liquid spray-on to the mix of particulate materials (e.g. non-ionic surfactants) may be carried out. Other liquid ingredients may also be sprayed on to the mix of particulate materials either separately or premixed. For example perfume and slurries of optical brighteners may be sprayed. A finely divided flow aid (dusting agent such as zeolites, carbonates, silicas) can be added to the particulate materials after spraying the non-ionic, preferably towards the end of the process, to make the mix less sticky.

The detergent particles can be made by an agglomerate process comprising the steps of:

i) admixing one or more detergent surfactants, a perborate component and an acid source and optionally other detergent ingredients to form a mixture; and ii) agglomerating the mixture to form agglomerated particles or "agglomerates".

Typically, such an agglomeration process involves mixing an effective amount of powder, including the acid source, with a high active surfactant paste in one or more agglomerators such as a pan agglomerator, a Z-blade mixer or more preferably in-line mixers, preferably two, such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7–9, Postfach 2050, Germany. Preferably a high shear mixer is used, such as a Lodige CB (Trade Name). Most preferably, a high shear mixer is used in combination with a low shear mixer, such as a Lodige CB (Trade Name) and a Lodige KM (Trade name) or Schugi KM (Trade Name). Optionally, only one or more low shear mixer arc used. Preferably, the agglomerates are thereafter dried and/or cooled.

Another agglomeration process involves mixing of various components of the final agglomorate in different stages, using an fluidized bed. For example, a preferred particulate detergent in accordance with the present invention can be agglomerated by addition, preferably by spraying on, of nonionic, anionic surfactants and optionally a wax, or mixtures thereof, to the acid source in powdered form and other optional ingredients. Then, additional components, including the perborate bleach and optinally the alkali source or part thereof, can be added and agglomerated in one or more stages, thus forming the final agglomerate particle.

The agglomerates may take the form of flakes, prills, marumes, noodles, ribbons, but preferably take the form of granules. A preferred way to process the particles is by agglomerating powders (e.g. aluminosilicate, carbonate) with high active surfactant pastes and to control the particle size of the resulting agglomerates within specified limits. Typical particle sizes are from 0.10 mm to 5.0 mm in diameter, preferably from 0.25 mm to 3.0 mm in diameter, most preferably from 0.40 mm to 1.00 mm in diameter. Typically, the "agglomerates" have a bulk density desirably ,of at least 700 g/l and preferably, in a range of from about 700 g/l to about 900 g/l.

A high active surfactant paste comprising a mix of, typically, from 50% by weight to 95% by weight, preferably 70% by weight to 85% by weight of surfactant, and optionally it can contain an appropriate acid source. The paste may be pumped into the agglomerator at a temperature high enough to maintain a pumpable viscosity, but low enough to avoid degradation of the anionic surfactants used. An operating temperature of the paste of 50° C. to 80° C. is typical. Such pastes and methods for making and processing such pastes is for example described in WO 93/03128. In the present invention, the detergent particles made by agglomeration process have a bulk density of greater than about 600 g/l and the detergent is in the form of powder or a granulate.

Dry Detergent Material

The starting dry detergent material for making detergent tablets to carry out the present invention, comprises materials selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials. More preferably, the dry detergent material is selected from the group consisting of aluminosilicate, carbonates, sulfates, carbonate/sulfate complexes, and mixtures thereof. Most preferably, the dry detergent material comprise a detergent aluminosilicate builder which are referenced as aluminosilicate ion exchange materials and sodium carbonate.

The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/–gram/gallon, and more preferably in a range from about 2 grains $Ca^{++}$/gallon/minute/–gram/gallon to about 6 grains $Ca^{++}$/gallon/minute/–gram/gallon.

Additionally, those builder materials discussed previously as an optional coating agent can be used herein. These particular builder materials have the formula $(M_x)_i\ Ca_y\ (CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}$($x_i$ multiplied by the valence of $M_i$)+2y=2z is satisfied such that the formula has a neutral or "balanced" charge. Additional details and examples of these builder materials have been set forth previously and are incorporated herein by reference. Preferably, these builder materials are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, specially sodium, salts of the above. Preferred for use herein are the phosphates, carbonates, $C_{10-18}$ fatty acids, polycarboxylates, and mixtures thereof. More referred are sodium tripolyphosphate, tetrasodium pyrophosphate, citrate, tartrate ono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S.

Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

The Non-particulate Detergent Product

The detergent tablets can be prepared simply by mixing the solid ingredients together and compressing the mixture in a conventional tablet press as used, for example, in the pharmaceutical industry.

The detergent tablets provided can be made in any size or shape. Prior to compaction, the detergent particles may be surface treated with a flow aid according to the present invention. The detergent tablets provided may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). As used herein, the term "non-particulate detergent product" includes physical shapes such as tablets, blocks, bars and the like.

Detergent Core having Chamfered Edges

In the preferred embodiment of the present invention, the core is compressed into a tubular configuration having a polygonal cross-section and a plurality of surfaces meeting to form a plurality of edges, thereby forming a contoured core, wherein at least one of the plurality of edges is chamfered. The core, in alternate embodiments, has one or more of a triangular, circular, or rectangular cross-sections. Various cross-sections and shapes are envisioned to be within the scope of the present invention, such as tablets, bars and the like.

Figure 2:
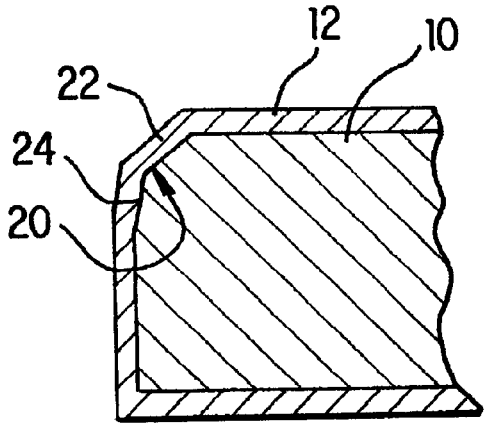
FIG. 2 shows a cross-sectional view of a portion of the detergent core, showing the details of a plurality of chamfers according to another embodiment of the present invention.
Figure 3:
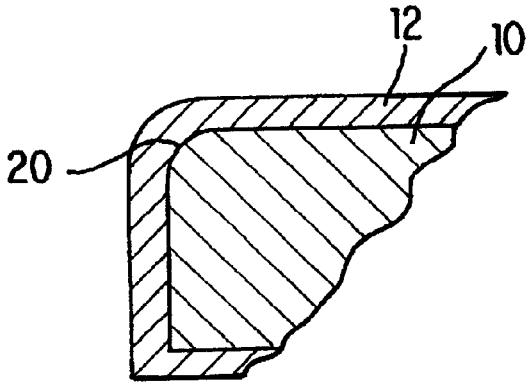
FIG. 3 shows a cross-sectional view of a portion of the detergent core, showing the details of a radiused chamfer according to yet another embodiment of the present invention.

The chamfered edges can have a variety of shapes and geometrical configurations. In one embodiment, as shown in FIG. 1, the core has a 45 degree chamfer. Various other angles are possible, ranging from 15 degrees to 75 degrees. Multiple chamfer are also envisioned in other embodiments of this invention. In one embodiment a plurality of chamfers are formed as shown in FIG. 2. Alternatively, the chamfer may be in the form of a radius as shown in FIG. 3. FIGS. 1, 2, and 3 each show a detergent core 10 covered by a coating 12. The coating 12 has a chamfered edge 20. FIG. 2 shows the chamfer having two surfaces 22, 24.

Coating for Non-particulate Detergent Product

In the preferred embodiment, the non-particulate detergent product further includes a coating which substantially covers the contoured core. Preferably, the coating mimics the surface contours of the core, thereby having an outer coating surface that has substantially similar surface geometry as that of the core.

The coating is provided in order to provide mechanical strength and shock and chip resistance to the compressed tablet core. The tablets are coated with a coating that is preferably substantially insoluble in water so that the tablet does not absorb moisture, or absorbs moisture at only a very slow rate. The coating is strong so that moderate mechanical shocks to which the tablets are subjected during handling, packing and shipping result in no more than very low levels of breakage or attrition. Further, the coating is preferably brittle so that the tablet breaks up when subjected to stronger mechanical shock. Furthermore it is advantageous if the coating material is dissolved under alkaline conditions, or is readily emulsified by surfactants. This avoids the deposition of undissolved particles or lumps of coating material on the laundry load. This may be important when the coating material is completely insoluble (for example less than 1 g/l) in water.

As defined herein "substantially insoluble" means having a very low solubility in water. This should be understood to mean having a solubility in water at 25° C. of less than 20 g/L, preferably less than 5 g/l, and more preferably less than 1 g/l. Water solubility is measured following the test protocol of ASTM E1148-87 entitled, "Standard Test Method for Measurements of Aqueous Solubility".

Suitable coating materials are fatty acids, adipic acid and C8–C13 dicarboxylic acids, fatty alcohols, diols, esters and ethers. Preferred fatty acids are those having a carbon chain length of from C12 to C22 and most preferably from C18 to C22. Preferred dicarboxylic acids are adipic acid (C6), suberic acid (C8), azelaic acid (C9), sebacic acid (C10), undecanedioic acid (C11), dodecanedioic acid (C12) and tridecanedioic acid (C13). Preferred fatty alcohols are those having a carbon chain length of from C12 to C22 and most preferably from C14 to C18.

Preferred diols are 1,2-octadecanediol and 1,2-hexadecanediol. Preferred esters are tristearin, tripalmitin, methylbehenate, ethylstearate. Preferred ethers are diethyleneglycol mono hexadecylether, diethyleneglycol mono octadecylether, diethyleneglycol mono tetradecylether, phenylether, ethyl naphtyl ether, 2 methoxynaphtalene, beta naphtyl methyl ether and glycerol monooctadecylether. Other preferred coating materials include dimethyl 2,2 propanol, 2 hexadecanol, 2 octadecanone, 2 hexadecanone, 2, 15 hexadecanedione and 2 hydroxybenzyl alcohol. The coating is a hydrophobic material having a melting point preferably of from 40° C. to 180° C.

In the preferred embodiment, the coating can be applied in a number of ways. Two preferred coating methods are a) coating with a molten material and b) coating with a solution of the material. In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 180° C. are not practicable to use. Preferably, the materials melt in the range from 60° C. to 160° C. , more preferably from 70° C. to 120° C.

By "melting point" is meant the temperature at which the material when heated slowly in, for example, a capillary tube becomes a clear liquid. For most purposes, the coating forms from 1% to 10%, preferably from 1.5% to 5%, of the tablet weight.

Compaction of Particulate Detergent to Form Non-particulate Detergent Product

In the preferred embodiment, the chip resistant detergent product has a core formed by compacting the particulate detergent composition by applying a pressure in an amount sufficient to form a non-particulate detergent product having a density of at least about 1000 g/l. It is desirable to form a detergent tablet that has a density of at least about 1000 g/l so that the tablet will sink in water. If the density of the detergent tablet is less than about 1000 g/l, the tablet will float when placed in the water in a washing machine and this will detrimentally reduce the dissolution rate of the tablet in the water. It is desirable to apply at least that much pressure as is sufficient to compress the particulate detergent material to form a tablet having a density of at least about 1000 g/l.

EXAMPLE A

Detergent tablets are formed according to the following composition:

TABLE A.1

| Particulate detergent Ingredients | % by weight |
|---|---|
| $C_{12-16}$ linear alkylbenzene sulfonate | 8.80 |
| $C_{14-15}$ alkyl sulfate/$C_{14-15}$ alkyl ethoxy sulfate | 8.31 |
| $C_{12-13}$ alkyl ethoxylate | 1.76 |
| polyacrylate (MW = 4500) | 2.40 |
| polyethylene glycol (MW = 4000) | 0.96 |
| sodium sulfate | 8.40 |
| aluminosilicate | 21.28 |
| sodium carbonate | 16.80 |
| protease enzyme | 0.32 |
| sodium perborate monohydrate | 2.08 |
| lipase enzyme | 0.17 |
| cellulase enzyme | 0.08 |
| NOBS extrudate | 4.80 |
| citric acid monohydrate | 2.25 |
| sodium bicarbonate | 2.75 |
| sodium acetate | 15.00 |
| free water | 1.60 |
| other minor ingredients (perfume etc.) | 2.24 |
| Total | 100.00 |

The detergent tablet formed is coated with a coating according to the following composition:

TABLE A.3

| Ingredient | % by weight |
|---|---|
| Detergent core | 91.10 |
| Coating: | |
| dodecanedioc acid | 8.00 |
| carboxymethyl cellulose | 0.90 |
| Total | 100.00 |

The tablets are formed by compressing the tablet ingredients in a cylindrical die having a diameter of 55 mm using a laboratory press having a trade name Carver Model 3912, to form a tablet having a height of 20 mm. The formed tablets are then coated with the protective coating by dipping the tablet into a molten bath of the coating for about 3 seconds. The molten coating bath is maintained at a temperature of about 145 degrees centigrade.

The term "NOBS extrudate" as used herein, is an acronym for the chemical sodium nonanoyloxybenzene sulfonate, commercially available from Eastman Chemicals, Inc. The carboxymethyl cellulose used in the above example is commercially available from Metsa-Serla and sold under the trade name, Nymcel ZSB-16.

Accordingly, having thus described the invention in detail, it will be obvious to those skilled in the art that various changes may be made without departing from the scope of the invention and the invention is not to be considered limited to what is described in the specification.

What is claimed is:

1. A non-particulate laundry and/or automatic dishwashing detergent product, comprising:

a core formed by compressing a particulate material, wherein the particulate material comprises a detersive surfactant and a builder;

said core having a tubular configuration having a polygonal cross-section and a plurality of surfaces meeting to form a plurality of edges, thereby forming a contoured core, wherein at least one of said plurality of edges is chamfered; and wherein the contoured core is substantially covered by a coating.

2. The non-particulate detergent of claim 1 wherein said coating covers said contoured core.

3. The non-particulate detergent of claim 1 wherein said core has a rectangular cross section.

4. The non-particulate detergent of claim 1 wherein said core has a triangular cross section.

5. The non-particulate detergent of claim 2 wherein said coating comprises dicarboxylic acid.

6. The non-particulate detergent product of claim 1 wherein said coating is insoluble in water.

7. The non-particulate detergent product of claim 1 wherein said coating comprises dicarboxylic acid.

8. The non-particulate detergent product of claim 1 wherein said coating comprises a material which is insoluble in water at 25 degrees C.

9. The non-particulate detergent product of claim 1 wherein said coating comprises a water-insoluble material having a melting point in the range of about 40 degrees C to about 180 degrees C.

10. The non-particulate detergent product of claim 1 wherein said coating is selected from the group of materials consisting of C12–C22 fatty acids, adipic acid, C8–C13 dicarboxylic acids, or mixtures thereof.

11. The non-particulate detergent product of claim 1 wherein said coating is selected from the group of materials consisting of C12–C22 fatty alcohols.

12. The non-particulate detergent product of claim 1 wherein said core has s density of at least 1000 g/l.

13. The non-particulate detergent product of claim 1 wherein said chamfer is a 45 degree chamfer.

14. The non-particulate detergent product of claim 1 wherein said chamfer has an angle in a range of from about 15 degrees to about 75 degrees.

15. The non-particulate detergent product of claim 1 wherein said chamfer is a radiused chamfer.

16. The non-particulate detergent product of claim 1 wherein said chamfer comprises a plurality of surfaces.

* * * * *